United States Patent [19]

Reynolds et al.

[11] 4,316,578

[45] Feb. 23, 1982

[54] DIRECT FIXATION RAIL FASTENER UTILIZING A PAD OF ELASTOMER

[76] Inventors: Clarke Reynolds, 16 St. Bernard La., Tiburon, Calif. 94920; Richard J. Quigley, 25538 Adobe La., Los Altos Hills, Calif. 94022

[21] Appl. No.: 155,427

[22] Filed: Jun. 2, 1980

[51] Int. Cl.[3] ..... E01B 9/48; E01B 9/62; E01B 9/68

[52] U.S. Cl. ..... 238/283; 238/264; 238/287; 238/310; 238/382

[58] Field of Search ..... 238/264, 283, 287, 304, 238/306, 307, 310, 349, 382

[56] References Cited

U.S. PATENT DOCUMENTS 4,047,663 9/1977 Reynolds et al. ..... 238/283 X 4,150,791 4/1979 Reynolds et al. ..... 238/283 X

*Primary Examiner*—Randolph A. Reese

*Attorney, Agent, or Firm*—Lowhurst & Aine

[57] ABSTRACT

A rail fastener includes a rail plate, a pad of elastomeric material between the plate and a support structure, a pair of clips for resiliently clamping the rail to the rail plate. The rail plate includes a pair of channels in which the clips occupy a first portion. The pad of elastomeric material preferably includes a pair of bosses dimensioned to be received within the unoccupied portion of the channel. The pad of elastomeric material is constrained from creeping out from underneath the rail plate whenever the bosses contact the end portions of the clips or the walls of the channel. The bosses are preferably noncompressable elastomeric material.

3 Claims, 4 Drawing Figures

DIRECT FIXATION RAIL FASTENER UTILIZING A PAD OF ELASTOMER

BACKGROUND OF THE INVENTION

This invention relates generally to a rail fastener and more particularly to an improvement in a direct fixation rail fastener for holding a rail onto a support structure which provides electrical isolation and vibration and sound attenuation between the rail and support structure.

Direct fixation rail fasteners have been employed extensively in recent years in place of tie-on ballast arrangements for affixing transit rails to rigid support structures. One known rail fastening system employs a rail plate shaped to accommodate the rail and a pad of elastomer sandwiched between the rail plate and the support structure. A pair of clips provide resilient clamping of the rail to the rail plate. The rail plate is fastened to the support structure through a pair of posts extending upwardly from the support structure through insulative bushings which allow limited vertical displacement of the rail plate with respect to the support structure as well as providing lateral adjustment of the rail with respect to the support structure. Examples of such rail fastenering systems are disclosed in U.S. Pat. Nos. 4,047,663 and 4,150,791.

Even though the rail fasteners disclosed in these patents accomplish these stated objects, the pad of elastomer at times exhibits a squirm which results from forces applied to the rail by the wheels of a rail-mounted vehicle. As the vehicle moves along a track, a differential pressure wave is caused to build up in the rail in front of the vehicle because of the leverage action which results from the localized vertical forces applied to the rail by the wheels of the vehicle. In addition to the differential pressure wave, the rail will be subjected to overturning moments and sheer forces particularly in a curved portion of the track. Prolonged squirming of the pad may allow the pad to creep out from underneath the rail plate resulting in decreased performance of the rail fastener.

SUMMARY OF THE INVENTION

It is, therefor, a primary object of the present invention to provide a rail fastener with an improved pad of elastomer which is constrained from creeping out from underneath the rail plate.

It is a further object of the present invention to provide a rail fastener with an improved pad of elastomer which minimizes the squirm inherent during the application of forces applied to the rail.

It is still a further object of the present invention to provide an improved pad of elastomer which conforms to the shape of the rail plate to constrain movements with respect to the rail plate.

According to the invention, a rail fastener comprises a rail plate seated on a pad of elastomer to allow the plate to move downwardly under load. The rail plate is fastened to a pair of posts upwardly extending from the support structure through insulative bushings. The rail plate is shaped with a well to accommodate the rail and restrain the rail against lateral displacement. The well is formed by bows of generally U-shaped configuration in the rail plate and the bows define channels on the underside of the rail plate. A pair of clips resiliently clamp the rail to the rail plate. The clips are anchored in and occupy a first portion of each channel. The improvement to the pad of elastomer includes a generally U-shaped boss integral with and extending from the surface of the pad dimensioned to be received within the remaining portions of the channels.

The invention, however, as well as other objects, features and advantages thereof, will be more fully realized and understood from the following detailed description, when taken in conjunction with the accompanying drawing, wherein:

DETAILED DESCRIPTION OF THE PREFERRED EMBODIMENT

Figure 1:
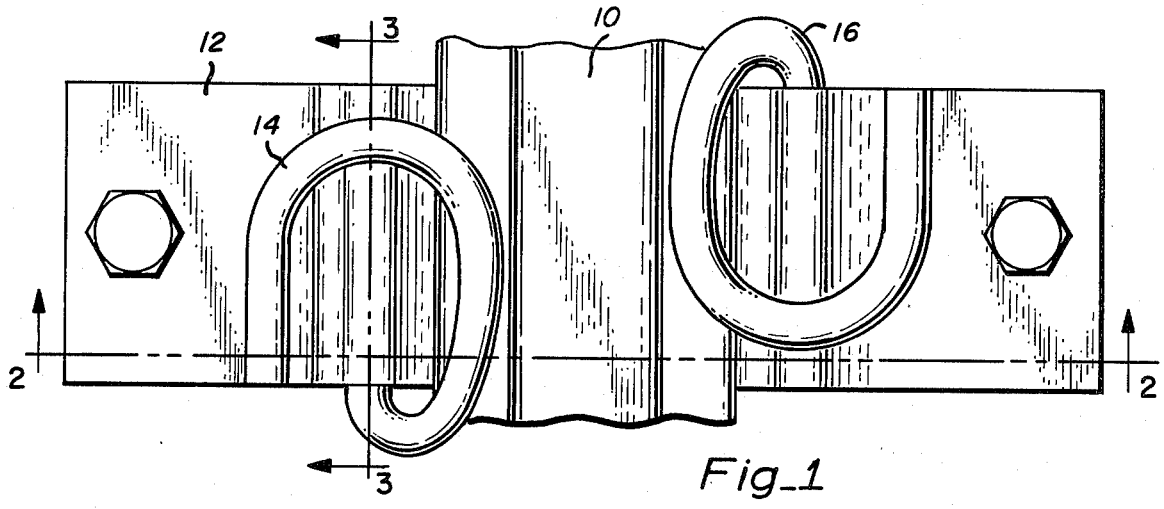
FIG. 1 is a plan view of a rail fastener of the present invention.
Figure 2:
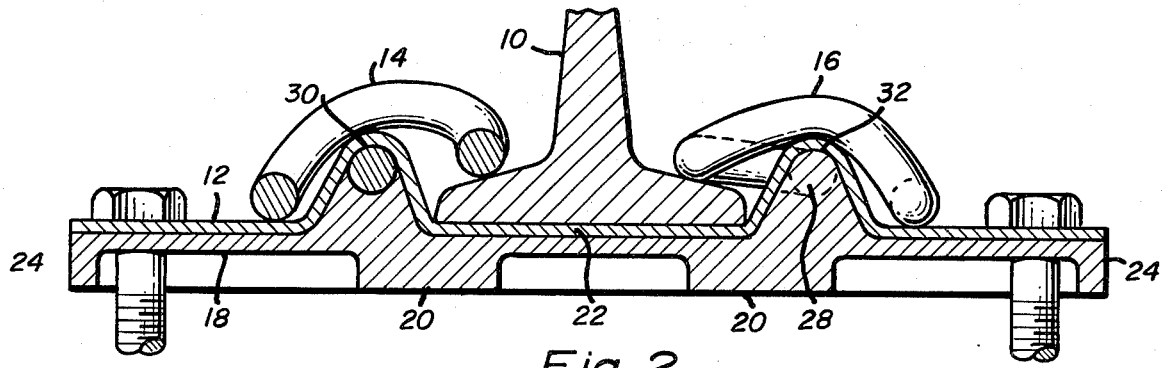
FIG. 2 is a sectional view taken generally along line 2—2 of FIG. 1.
Figure 3:
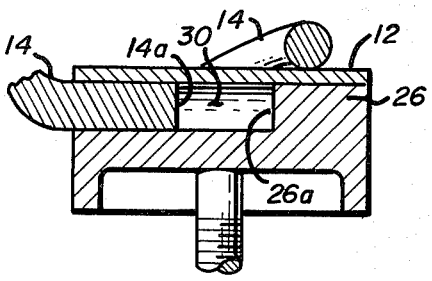
FIG. 3 is a sectional view taken generally along line 3—3 of FIG. 1.
Figure 4:
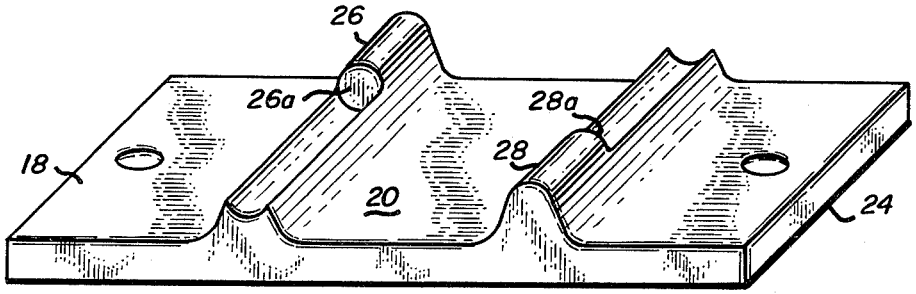
FIG. 4 is a perspective view of the elastomeric pad illustrating the improvements thereon of the present invention.

Referring now to FIGS. 1 through 4, there is shown a rail fastener for holding a rail 10 onto a support structure (not shown) such as a concrete slab. The fastener generally includes a rail plate 12 and a pair of Pandrol clips 14 and 16 for resiliently clamping the rail 10 to the rail plate 12. Additionally, a layer of elastomeric material 18 is disposed between the rail plate 12 and the support structure. The construction and use of the hereinabove described rail fastener have been disclosed in U.S. Pat. Nos. 4,047,663 and 4,150,791 and the teachings therein are hereby incorporated by reference and made a part hereof.

Elastomeric layer 18 at the lower surface of rail plate 12 includes a relatively thick pad of elastomer 20 co-extensive with central section 22 of rail plate 12 and a skirt portion 24 which is co-extensive with the periphery of rail plate 12 for sealing the bottom of the rail plate from the elements.

The improvement in the elastomeric layer 18 comprises a pair of generally U-shaped bosses 26 and 28 integral with and extending upwardly from pad 20. Each boss 26 and 28 in cross section is dimensioned to be received within the channels 30 and 32 formed on the underside of rail plate 12 unoccupied by the pair of clips 14 and 16.

The length of each boss 26 and 28 within the respective channels 30 and 32 is preferably not less than one-quarter or not greater than one-half the length of the channel. It is desired that the unoccupied channel mid-portion or gap between the end of each clip and the end of the associated boss be small to afford each of the channel occupants the maximum clamping support, for example less than one-eighth the length of the channel. Preferably the pair of bosses 26 and 28 are of noncompressable elastomeric material.

Upon the application of the forces generated by the rail-mounted vehicle as hereinabove described, each boss 26 and 28 will restrain the pad 20 from being displaced with respect to the rail plate 12. Longitudinal displacement is constrained when either of the boss end portions 26*a* or 28*a* contact either of the clip end portions 14*a* or 16*a*. Lateral displacement is constrained by each boss 26 and 28 having an outer surface dimensioned to be flushly fitted with the walls of the channels 30 and 32. Constraining both longitudinal and lateral displacement will also constrain rotational displacement and prevent the pad 20 from squirming and slipping out from underneath the rail plate 12.

There has been described novel apparatus and techniques providing an improved pad of elastomer which does not creep out from underneath the rail plate during the application of forces generated by a rail-mounted vehicle. It is evident that those skilled in the art may now make numerous uses and modifications of and departures from specific embodiments described herein without the parting from the inventive concepts. Consequently, the invention is to be construed as embracing each and every novel feature and novel combination of features present and are possessed by the apparatus or techniques herein disclosed and limited solely by the spirit and scope of the appended claims.

What is claimed is:

1. In a fastener for supporting a rail on a support structure which includes, a rail plate for supporting the rail which has a well dimensioned to accommodate the rail, the sides of the well being formed by bows of generally U-shaped configuration in the rail plate, the bows defining channels on the underside of the rail plate, a pair of clips anchored in and occupying a first portion of each channel for resiliently clamping the rail to the rail plate, a pad of elastomer mounted between the rail plate and the support structure, and a pair of posts connected to the support structure for laterally restraining the rail plate with respect to the support structure, the improvement of the pad of elastomer comprising:

at least one generally U-shaped boss integral with and extending from one surface of the pad, said boss being dimensioned to be received within a second portion of one of said channels for laterally and longitudinally restraining said pad from movement with respect to the rail plate, the opposing end portions of said boss and said clip facing each other within said channel and defining an unoccupied channel midportion therebetween.

2. In a fastener for supporting a rail in accordance with claim 1 in which the length of said channel midportion is less than one-eighth the length of said channel.

3. In a fastener for supporting a rail in accordance with claim 1 which includes a further generally U-shaped boss integral with and extending from the surface of said pad, said further boss being dimensioned to be received within a second portion of the other channel for rotationally restraining said pad with respect to the rail plate.

* * * * *